US011058213B1

(12) United States Patent
Macrina

(10) Patent No.: US 11,058,213 B1
(45) Date of Patent: Jul. 13, 2021

(54) ADAPTIVE BRUSH HOLDER KIT

(71) Applicant: Susan C. Macrina, Marcy, NY (US)

(72) Inventor: Susan C. Macrina, Marcy, NY (US)

( * ) Notice: Subject to any disclaimer, the term of this patent is extended or adjusted under 35 U.S.C. 154(b) by 81 days.

(21) Appl. No.: 16/433,161

(22) Filed: Jun. 6, 2019

(51) Int. Cl.
*A46B 17/02* (2006.01)

(52) U.S. Cl.
CPC ..... *A46B 17/02* (2013.01); *A46B 2200/205* (2013.01)

(58) Field of Classification Search
CPC ..... A46B 17/02; A46B 2200/205
USPC ..... 15/146
See application file for complete search history.

(56) References Cited

U.S. PATENT DOCUMENTS 3,319,280 A * 5/1967 Trachsler ..... A46B 17/02 15/146
3,604,044 A 9/1971 Johnson
3,737,187 A * 6/1973 Pryor ..... B05C 21/00 294/119.2
4,165,896 A * 8/1979 Hunt ..... B43L 15/00 15/443
5,072,904 A 12/1991 Taylor
5,609,255 A * 3/1997 Nichols ..... A47L 13/20 15/144.3
5,862,564 A * 1/1999 Hamm ..... A47K 7/08 15/143.1
5,991,956 A 11/1999 Chapman
6,148,467 A 11/2000 Martinsson
6,981,293 B2 * 1/2006 Steinberg ..... A47K 7/028 15/104.94
7,100,238 B2 * 9/2006 McCauley ..... A46B 5/0062 15/144.1
7,278,668 B1 * 10/2007 Simmons ..... A46B 17/02 16/422
D586,060 S 2/2009 Kahn
D661,907 S 6/2012 Birkland
8,839,480 B2 9/2014 Thomas
8,875,337 B2 * 11/2014 Tacoma ..... A47K 7/028 15/209.1
9,630,311 B2 4/2017 Creelman
10,004,325 B1 * 6/2018 Koyzis ..... A46B 5/0058
2004/0143921 A1 * 7/2004 Borkin ..... B44D 3/00 15/106
2005/0183904 A1 * 8/2005 Bacalso ..... A63B 29/08 182/5
2015/0238006 A1 * 8/2015 Gaige ..... B25G 1/04 401/138
2016/0340906 A1 * 11/2016 Nichols ..... A46B 5/0054
(Continued)

FOREIGN PATENT DOCUMENTS

DE 29717156 U1 * 5/1998 ..... A46B 17/02
FR 712391 A * 10/1931 ..... A61H 7/003

*Primary Examiner* — Marc Carlson
(74) *Attorney, Agent, or Firm* — Cramer Patent & Design, PLLC; Aaron R. Cramer

(57) ABSTRACT

A configurable holding set that includes a handle element having a common end that extends into an elongated linear section having a receiving end. That common end further extends into a curvilinear section that forms a handle. Also included are a first linear element having two ends that form a friction fit with the receiving end, a second linear element that is longer than the first linear element, a third linear element that is longer than the third, at least a first elbow having ends that form friction fits with the ends of the first, second, and third.

11 Claims, 4 Drawing Sheets

(56) References Cited

U.S. PATENT DOCUMENTS

| | | | | |
|---|---|---|---|---|
| 2019/0167063 | A1* | 6/2019 | Balz | A46B 15/0055 |
| 2020/0018085 | A1* | 1/2020 | Lopez | E04H 4/1609 |

* cited by examiner

ADAPTIVE BRUSH HOLDER KIT

FIELD OF THE INVENTION

The presently disclosed subject matter is directed to aids for those having limited motor skills. More particularly, the present invention relates to a handheld holder for brushes and other such implements that are to be manipulated by those with limited motor skills.

BACKGROUND OF THE INVENTION

Throughout history one set of characteristics that has defined humanity is its ability, need, and desire to produce art. From ancient cave drawings to modern art people have expressed themselves and their environment through artwork.

Given the need for people to produce art paints, pencils, inks, crayons, brushes, spray cans, colors, papers, easels, and a whole range of other materials and devices have been developed to aid in the production of artwork. While such has been enormously successful over the centuries there is a small group of people under-served when it comes to the production of art: those having limited motor skills.

Limited fine motor skills can be caused by cerebral palsy and by a range of other degenerative diseases that reduce the muscle control skills in a person's hands and arms. Computers and the software have been applied to assist those having limited motor skills to produce art. However, such does not always fulfill the need of a person to physically create something tangible. People who work with those having limited motor skills have recognized that painting and drawing have therapeutic benefits.

However, the obvious problem that must be addressed to enable those with limited motor skills to physically paint, draw, and produce artwork is that they have limited motor skills. Therefore, devices that enable people with limited motor skills to physically paint and draw would be highly desirable. Preferably such devices would be highly configurable so as to enable use by a range of people of different ages and physical limitations. Even more preferably such devices would be directly manipulable by a user's hand. In practice, it may be beneficial to be able to lock the device in a particular configuration for reuse by the same user. Ideally, such devices would be suitable for being made available at low cost and would be easy to use, effective, and safe.

SUMMARY OF THE INVENTION

The principles of the present invention provide for highly configurable devices that enable people with limited motor skills to produce artwork. Such devices include handles suitable for enabling those with limited motor skills to grasp the device well as implementing holders for brushes or pens. Such devices are suitable for temporary use as well as for being permanently fixed together. To such ends the device can be made of low cost PVC or another plastic in such a manner that friction fits are created between device elements. The inventive devices are suitable for being made available at low cost, are easy to use, and can be safely used by people with limited motor skills.

A configurable holding set that is in accord with the present invention includes a handle element having a common end that extends into an elongated linear section which terminates in a receiving end. That common end further extends into a curvilinear section that forms a handle that extends away from the linear section. The holding set further includes a first linear element having two ends, each of which is configured to form a friction fit with the receiving end of the handle element. There may also be a second linear element that is longer than the first linear element, that second linear element having similar ends as the first linear element. There may also be a first elbow having ends that form friction fits with the ends of the first and the second linear elements.

In practice, the holding set may further include a third linear element that is longer than the second linear element, that third linear element having similar ends as the first and second linear elements, and possibly a fourth linear element that is longer than the third linear element, with that fourth linear element having similar ends as the first, second and third linear elements. Beneficially, there may also be a second elbow having ends that form friction fits with the ends of the first and the second linear elements. The first elbow beneficially forms either a 90 degree angle or a 45 degree angle. In practice, the implement can be a brush. Also in practice the holding set may be made of PVC.

Alternatively, a configurable holding set may have a handle element with a common end that extends into an elongated linear section that terminates in a receiving end. That common end further extends into a curvilinear section element that forms a handle that extends away from the linear section. There will be a first linear element having two ends, each of which is configured to form a friction fit with the receiving end, a second linear element having two ends at our configured to form friction fits with the receiving end, that second linear element being longer than the first linear element, and a first elbow having ends that form friction fits with the ends of the first and the second linear elements. There is also a brush that is configured to mate with either end of the first linear element.

The alternative holder set may further include a first elbow that forms either a 90 degree or a 45 degree angle. In practice, there will also be a second elbow, a third linear element that is longer than the second linear element and a fourth linear element that is longer than the third linear element. In any event, the first elbow end can form friction fits with the ends of the first linear element. Also in practice the handle element will be comprised of plastic, preferably PVC.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
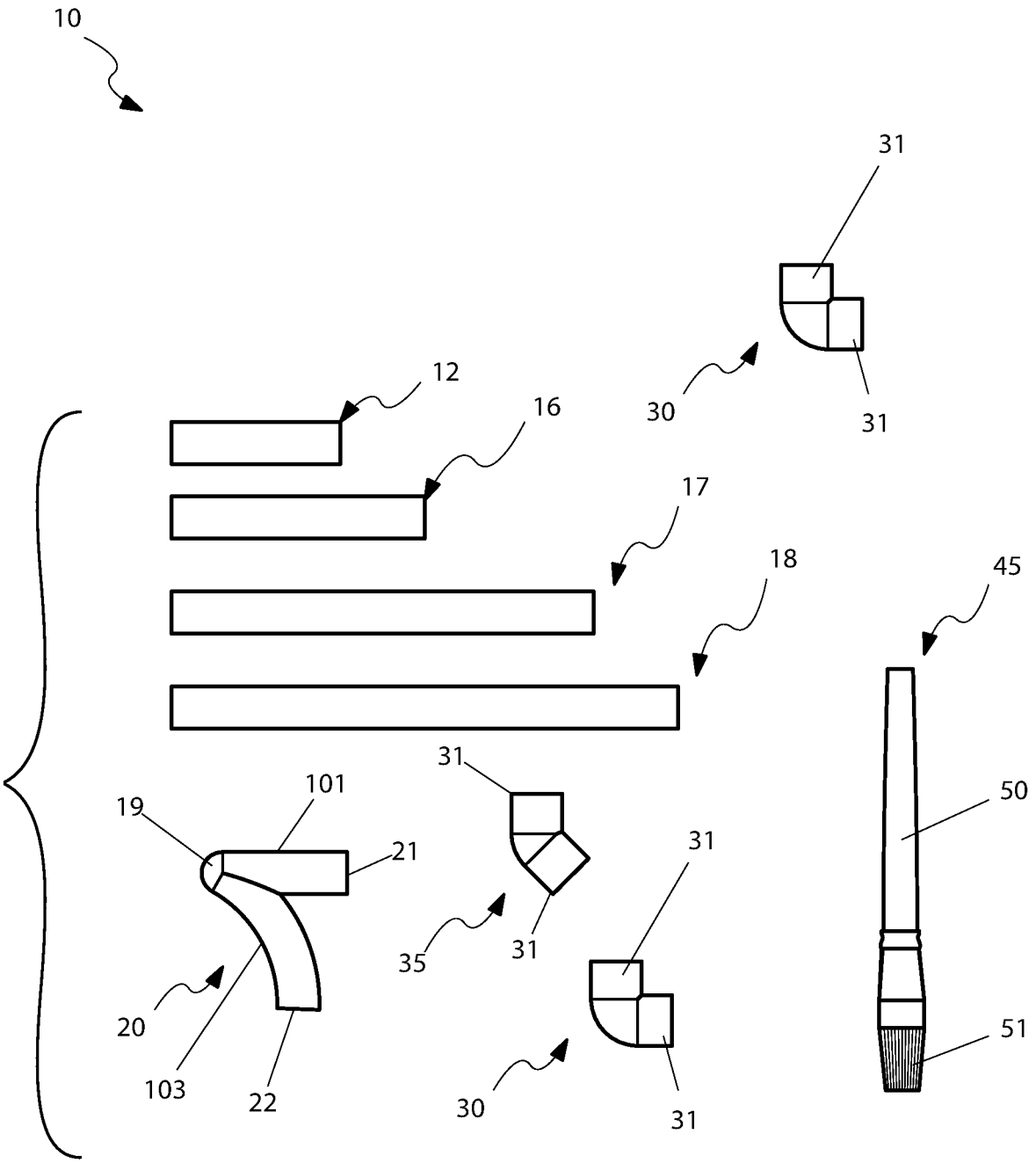
FIG. 1 is a collection view of a holding set 10 that is in accord with a preferred embodiment of the present invention.

10 holding set
12 first linear element

16 second linear element
17 third linear element
18 fourth linear element
19 common end
20 handle element
21 first receiving end
22 second receiving end
30 elbow element
31 first elbow receiving end
35 angled element
37 angled element receiving end
45 painting brush
50 handle
51 brush
101 linear section
103 curvilinear section

DESCRIPTION OF THE PREFERRED EMBODIMENTS

The preferred embodiment of the present invention is depicted in FIGS. 1 through 6. However, the invention is not limited to the specifically described embodiment. A person skilled in the art will appreciate that many other embodiments of the invention are possible without deviating from the basic concept of the invention. Any such work around will also fall under the scope of this invention.

In the figures like numbers refer to like elements throughout. Additionally, the terms "a" and "an" as used herein do not denote a limitation of quantity, but rather they denote the presence of at least one of the referenced items.

Elements of a holding set 10 which is in accord with the present invention are depicted in FIG. 1. The holding set 10 is a collection of interchangeable parts that can be configured in many different ways, some of which are depicted in FIGS. 2-6. However, it should be understood that the present invention can be configured in many other ways and in many other styles and configurations. Thus the particular illustrated holding set 10 and it configurations are shown and described for purposes of clarity of disclosure and not by way of limitation of scope.

FIG. 1 illustrates a holding set 10 that is suitable for holding and manipulating an implement such as a painting brush 45 in useful ways. The holding set 10 includes a first linear element 12, a second linear element 16 that is longer than the first linear element 12, a third linear element 17 that is longer than the second linear element 16, a fourth linear element 18 that is longer than the third linear element 17, a handle element 20, at least one elbow element 30, and an angled elbow 35. While FIG. 1 shows a painting brush 45 it should be understood that other implements may be held by the holding set 10.

Still referring to FIG. 1, each of the elements 12, 16, 17, 18, 20, 30 and 35 is a tubular, preferably cylindrical, structure. Those elements 12, 16, 17, 18, 20, 30 and 35 are beneficially made of polyvinyl chloride (PVC) and have an inner diameter of three-quarters of an inch (¾ in.). The first linear element 12 is preferably four inches (4 in.) long, the second linear element 16 six inches (6 in.) long, the third linear element 17 ten inches (10 in.) long, and the fourth linear element 18 twelve inches (12 in.) long. Of course these are merely illustrative lengths and the various linear elements 12, 16, 17, 18 may have other dimensions, both in length and in diameter, as well as being comprised of different materials.

The handle element 20 includes a four inches (4 in.) long linear section 101 having a first common end 19 and a first receiving end 21. That handle element 20 further includes a curvilinear section 103 that curves away from the common end 19 and ends in a second receiving end 22. The common end 19 is formed from a fusion of the linear section 101 and the curvilinear section 103. The faces of the first and second receiving ends 21, 22 are beneficially perpendicular. Any of the linear elements 12, 16, 17, 18 can be inserted into one of the receiving ends 21, 22 to form a frictional fit. Importantly, the curvilinear section 103 forms a handle for a user to grasp and manipulate the painting brush 45 (or other implement) when in use.

Each elbow element 30 is a short radius ninety degree (90°) elbow fitting having ends 31 that are configured to receive any of the linear elements 12, 16, 17, or 18. As an alternative a longer radius ninety degree (90°) elbow may be beneficial in some applications.

The intermediate angled element 35 forms a bend with an angle between zero and ninety degrees (90°), for example forty-five degrees (45°). The intermediate angled element 35 has ends 37 that are configured to receive any of the linear elements 12, 16, 17, or 18.

The first, second, third, and fourth linear elements 12, 16, 17, 18 are beneficially open-ended, hollow tubular members. However, other embodiments those elements may be solid or have different cross-sectional shapes. But, the interconnectivity between the linear elements 12, 16, 17, 18 and the more complex elements 20, 30 and 35 are important. To form more permanent connections when elements are fit together potting compounds, chemical welding agents, or adhesives can be used to supplement the frictional fitting between the elements. The entire holding set 10 can be packaged and sold together or the various elements can be made separately available. It is envisioned that any number of any of the elements 12, 16, 17, 18, 20, 30 and 35 may be included within a given holding set 10 and that various implements may be included with a given set.

Figure 2:
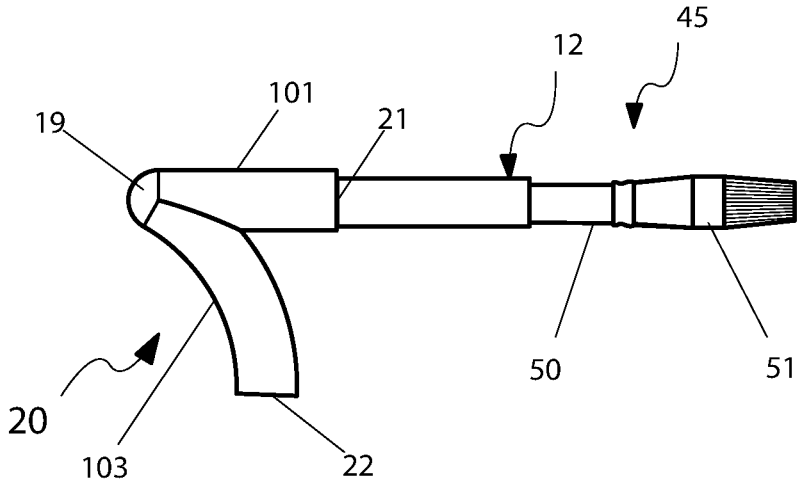
FIG. 2 is a side elevation view of a first assembly configuration of the holding set 10 of FIG. 1.

In use a painting brush 45 or other implement having a handle 50 can be inserted into any of the free ends of the various linear elements. FIGS. 2-6 show various configurations of elements in which the brush 51 end of a painting brush 45 is free for use. FIG. 2 shows a first linear element 12 inserted into a first receiving end 21 of a handle element 20, and the handle 50 of a paint brush 45 inserted into an end of the first linear element 12. With this configuration a user can use the curvilinear section 103 of the handle element 20 to manipulate the brush 51.

Figure 3:
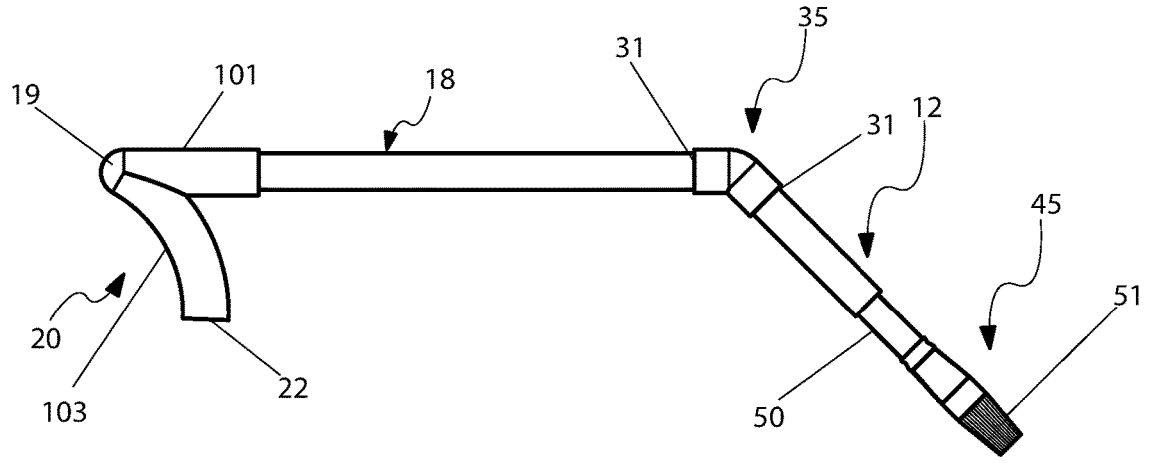
FIG. 3 is a side elevation view of a second assembly configuration of the holding set 10 of FIG. 1.

FIG. 3 illustrates a second in-use configurations of the holding set 10. As shown a first linear element 12 is attached to a first elbow receiving end 31 of an angled element 35, while the handle 50 of a paint brush 45 is inserted into the opposite end of the first linear element 12. A fourth linear element 18 is inserted into the other first elbow receiving end 37 of the angled element 35. The opposite end of the fourth linear element 18 is inserted into the first receiving end 21 of the handle element 20. The curvilinear section 103 of the handle element 20 can once again be used to manipulate the brush 51.

Figure 4:
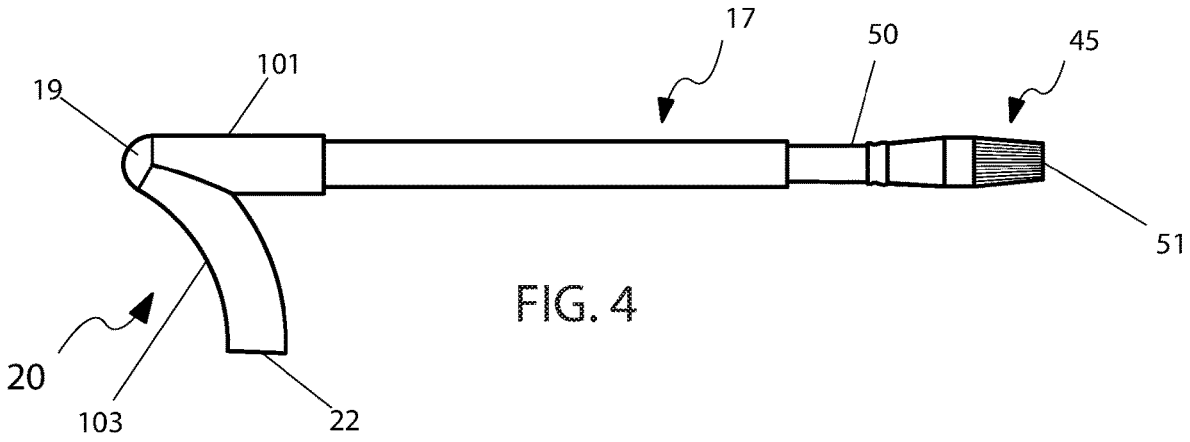
FIG. 4 is a side elevation view of a third assembly configuration of the holding set 10 of FIG. 1.

FIG. 4 illustrates a third in-use configurations of the holding set 10. As shown a third linear element 17 is inserted into a first receiving end 21 of a handle element 20, and the handle 50 of a painting brush 45 inserted into an end of the third linear element 17. Again, a user can use the curvilinear section 103 of the handle element 20 to manipulate the brush 51.

Figure 5:
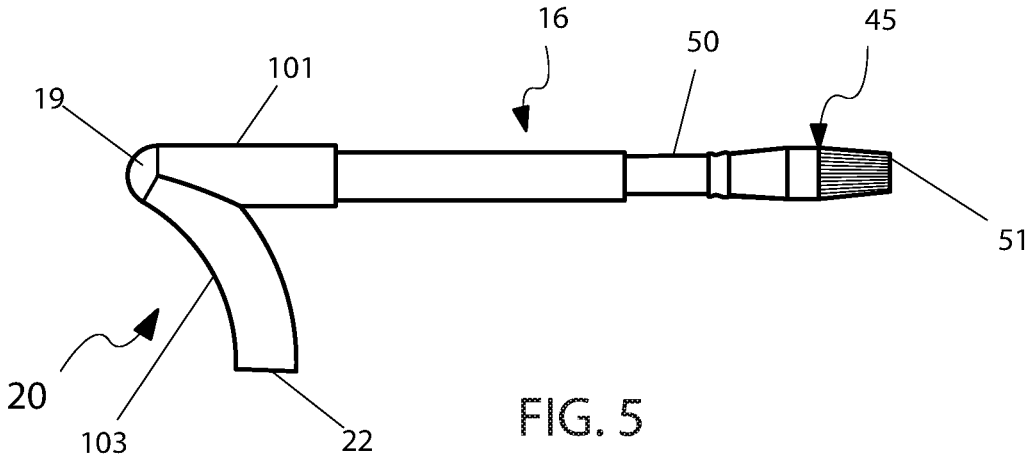
FIG. 5 is a side elevation view of a fourth assembly configuration of the holding set 10 of FIG. 1; and, FIG. 6 is a side elevation view of a fifth assembly configuration of the holding set 10 of FIG. 1.

FIG. 5 illustrates a fourth in-use configurations of the holding set 10. As shown a second linear element 16 is inserted into a first receiving end 21 of a handle element 20, and the handle 50 of a painting brush 45 inserted into an end of the second linear element 16. Again, a user can use the curvilinear section 103 of the handle element 20 to manipulate the brush 51.

Figure 6:
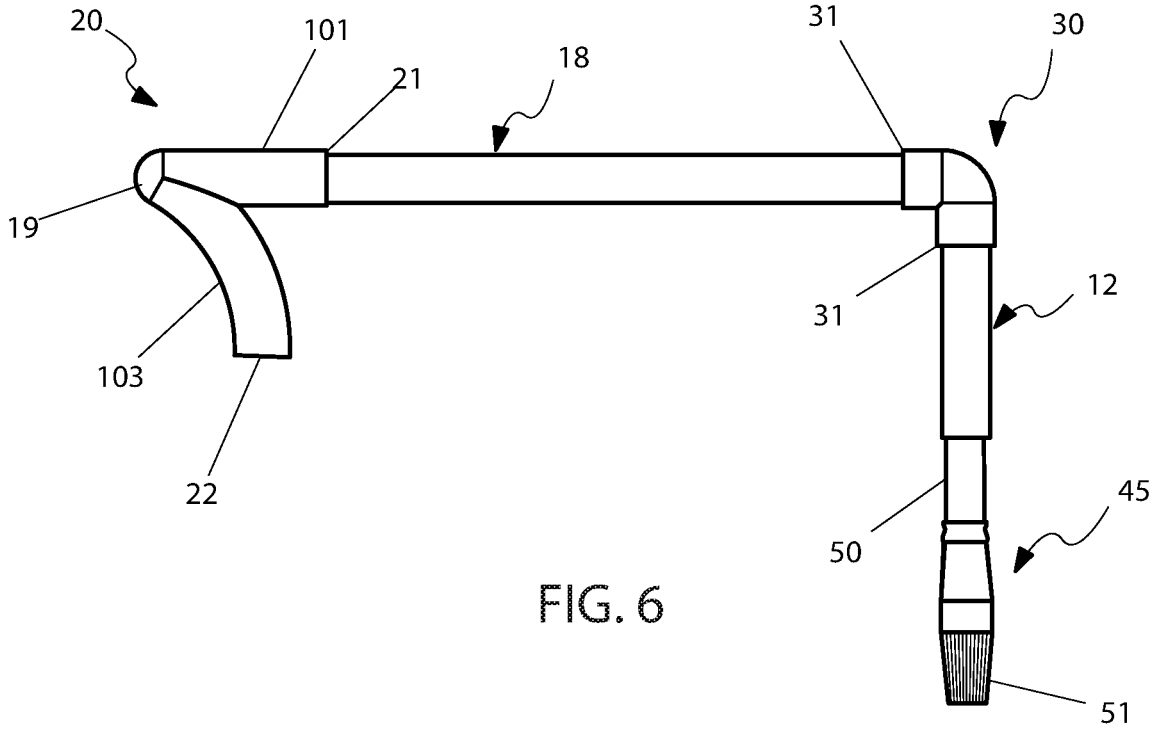

FIG. 6 illustrates a fifth in-use configurations of the holding set 10. A fourth linear element 18 is attached to the first receiving end 21 of a handle element 20. The opposing second receiving end 22 is open. The other end of the fourth linear element 18 is attached to the first elbow receiving end 31 of an elbow element 30. A first linear element 12 is attached to that elbow element 30. The handle 50 of a painting brush 45 is inserted into the end of the first linear element 12 that is opposite the elbow element 30. Once again, a user can use the curvilinear section 103 of the handle element 20 to manipulate the brush 51.

The foregoing descriptions of specific embodiments of the present invention have been presented for purposes of illustration and description. They are not intended to be exhaustive or to limit the invention to the precise forms disclosed. Many modifications and variations are possible in light of the above teaching. The embodiments were chosen and described in order to best explain the principles of the invention and its practical application, to thereby enable others skilled in the art to best utilize the invention with various modifications as are suited to the particular use contemplated.

What is claimed is:

1. An adaptive brush holder kit, comprising:

a handle element having a common end that extends into an elongated linear section that terminates in a receiving end, said common end further extending into a curvilinear section element that forms a handle that extends away from said linear section;

a first linear element having two ends, each of which is configured to form a friction fit with said receiving end;

an implement configured to mate with either end of said first linear element;

a second linear element that is longer than said first linear element, said second linear element having similar ends as said first linear element;

a first elbow having ends that form friction fits with said ends of said first and said second linear elements;

a third linear element that is longer than said second linear element, said third linear element having similar ends as said first and said second linear elements;

a fourth linear element that is longer than said third linear element, said fourth linear element having similar ends as said first, said second and said third linear elements; and a second elbow having ends that form friction fits with said ends of said first and said second linear elements;

wherein said first elbow forms a 90° angle; and wherein said implement is a brush.

2. The adaptive brush holder kit according to claim 1, wherein said handle element is comprised of PVC.

3. An adaptive brush holder kit, comprising:

a handle element having a common end that extends into an elongated linear section that terminates in a receiving end, said common end further extending into a curvilinear section element that forms a handle that extends away from said linear section;

a first linear element having two ends, each of which is configured to form a friction fit with said receiving end;

a second linear element having two ends configured to form a friction fit with said receiving end, said second linear element being longer than said first linear element;

a first elbow having ends that form friction fits with said ends of said first and said second linear elements; and a brush configured to mate with either end of said first linear element.

4. The adaptive brush holder kit according to claim 3, wherein said first elbow forms and angle of 90°.

5. The adaptive brush holder kit according to claim 3, wherein said first elbow forms and angle of 45°.

6. The adaptive brush holder kit according to claim 3, further including a second elbow.

7. The adaptive brush holder kit according to claim 6, further including a third linear element that is longer than said second linear element.

8. The adaptive brush holder kit according to claim 7, further including a fourth linear element that is longer than said third linear elements.

9. The adaptive brush holder kit according to claim 8, wherein said first elbow end form friction fits with said ends of said first linear element.

10. The adaptive brush holder kit according to claim 3, wherein said handle element is comprised of plastic.

11. The adaptive brush holder kit according to claim 10, wherein said handle element is comprised of PVC.

* * * * *